US005403152A

United States Patent [19]

Trautloff et al.

[11] Patent Number: 5,403,152

[45] Date of Patent: Apr. 4, 1995

[54] STACKING ARRANGEMENT FOR AIR MOVERS

[76] Inventors: Gary L. Trautloff, 1632 Sunset La., Fullerton, Calif. 29633; Montgomery A. Bisson, 19822 Maritime, Huntington Beach, Calif. 92648

[21] Appl. No.: 122,245

[22] Filed: Sep. 16, 1993

[51] Int. Cl.[6] ..... F04D 17/08; F04D 29/42

[52] U.S. Cl. ..... 415/206; 416/63; 417/234; 417/423.14

[58] Field of Search ..... 415/206; 416/63; 417/234, 423.14; 206/499; 15/344, 405, 410, 412, 422.2

[56] References Cited

U.S. PATENT DOCUMENTS

| | | | |
|---|---|---|---|
| 4,756,668 | 7/1988 | Gassen et al. | 15/405 |
| 4,792,286 | 12/1988 | Gassen | 417/234 |
| 5,174,048 | 12/1992 | Shero | 415/206 |
| 5,205,711 | 4/1993 | Raczykowski | 416/63 |

*Primary Examiner*—Edward K. Look

*Assistant Examiner*—James A. Larson

*Attorney, Agent, or Firm*—Hawes & Fischer

[57] ABSTRACT

An air mover which allows for both side-by-side and coaxial stacking. An air mover is essentially composed of substantially a cylindrical fan or motor housing with an air exhaust nozzle extending tangentially therefrom. The side-by-side stacking arrangement includes the interlocking of the stacking register of the handle of the air mover with the underside of the accessory flange at the distal end of the nozzle. The handle snugly nests within the space formed by the nozzle as it extends tangentially from the motor housing. The coaxial stacking involves the interlocking of a tab on the nozzle and a circular projection on one planar surface of the air mover with a slot and circular depression on the opposite planar of another air mover. The diameter of the circular depression being greater than the diameter of the circular projection and the slot being sized to receive the tab. Alone or in combination, the interlocking systems provide for compact storage and transportation.

17 Claims, 3 Drawing Sheets

STACKING ARRANGEMENT FOR AIR MOVERS

BACKGROUND OF THE INVENTION

1. Field of the Invention

This invention relates to an improved air mover which has an interlocking system when coaxially stacked vertically and/or side-by-side which facilitates the transportation and storage of the air movers.

2. Background Art

Air movers are widely used by carpet cleaners to dry out carpets either after cleaning or after flooding or other events which result in wet carpets. Firefighters use them not only for drying, but also to move smoke filled air out of an area. There are other environmental uses in which the rapid movement of air is required and useful. Present air movers have a motor located in a cylindrical housing. The cylindrical motor housing has a nozzle projecting from it through which the air is exhausted. The surfaces and edges of the air mover are typically curved to prevent injury to the user and surrounding items. Most air movers have a handle to assist in transporting and manipulating the air mover. The handle, the rounded surfaces and edges make it virtually impossible to stack or closely pack air movers which results in excessive space being consumed during transportation and storage.

A low rectangular air mover was designed specifically to meet the storage problem. This boxy air mover stacked reasonably well, but its shape inhibited its main function, viz, moving air.

The combination of effective air mover and features which make storage and transportation efficient remained unsolved.

SUMMARY OF THE INVENTION

The instant invention enables air movers to be compactly stored and transported. This is possible due to the interlocking stacking systems which permits snug side by side placement and secure coaxially stacking of the air movers.

The side by side interlocking system includes a handle having a substantially quadrilateral shape which snugly fits within a complementary contoured recess of a second air mover. The contoured recess is formed by the accessory ring of the distal end of the air exhaust nozzle, the body of the nozzle and the motor housing. One edge of the handle is formed by a stacking register which continues across substantially the entire axial length of the air mover. This stacking register interlocks with the accessory ring of the adjacent air mover. Thus, it is the two accessory rings and two stacking registers which interlock the two air movers side by side. The snug fit of the handle within the contoured recess assists in maintaining the interconnection.

When coaxially stacked the air movers interlock at two points. Around the circumference of a perforated motor support there is a circular depression or female stacking register ring. Around the air mover intake screen there is a circular projection or male stacking register ring. When stacked these two stacking register rings engage and stabilize the stacked air movers. The accessory ring of the nozzle has a tab on one side and a matching elongated indentation or slot on the opposite side. When stacked the tab of the one air mover is received within the elongated slot of the second air mover. The interlocking of the female stacking register ring and male stacking ring along with the tab within the slot securely retain and orient the coaxially stacked air movers.

The combination of the horizontal and vertical interlocking systems allows four air movers to be positioned in an extremely compact space providing for ease of transportation and storage.

DETAILED DESCRIPTION OF THE INVENTION

Figure 1:
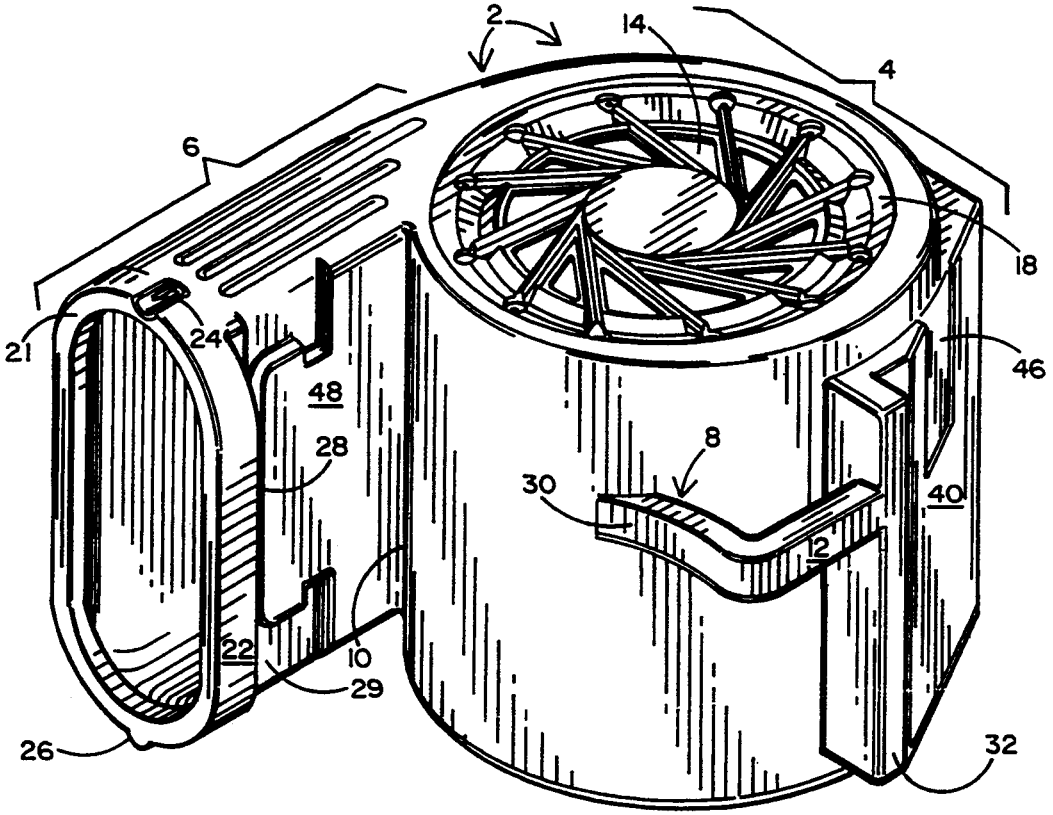
FIG. 1 is a perspective view of the air mover.
Figure 2:
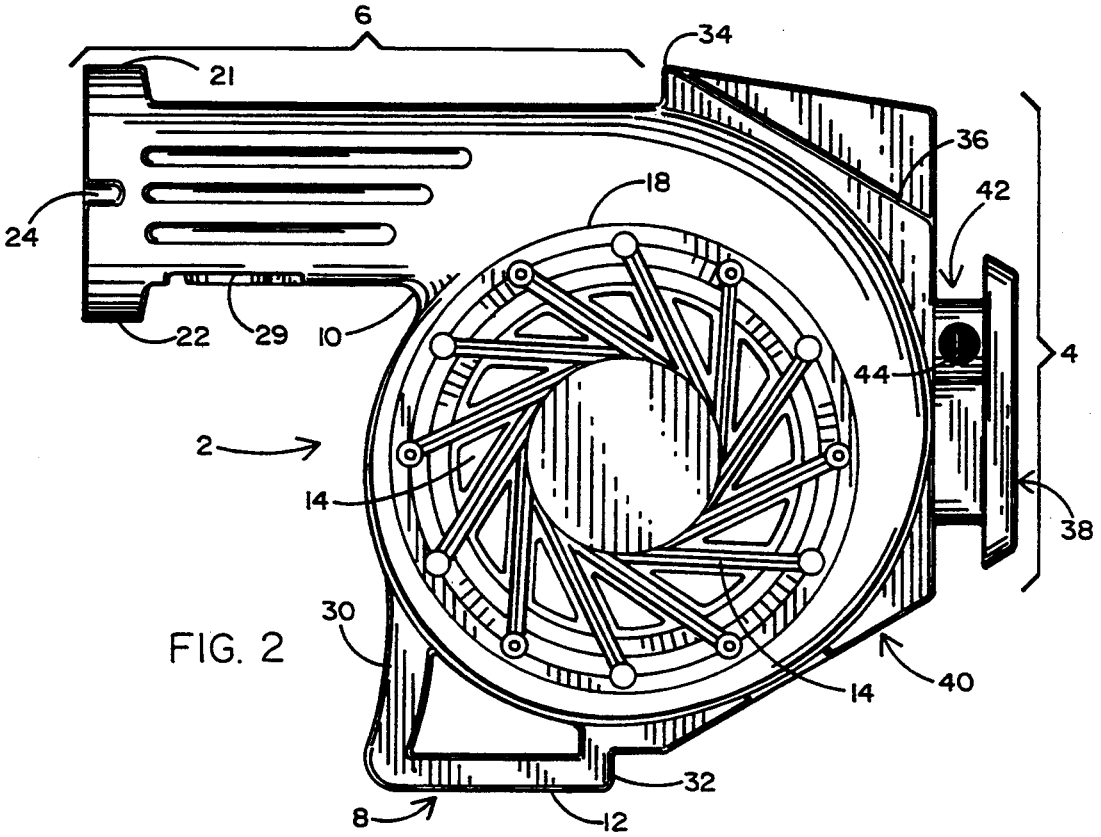
FIG. 2 is a side elevation of the air mover.

In the accompanying drawings, similar components bear similar reference numerals.

The invention is described while referring concurrently to FIGS. 1 through 6 of the drawings. Referring initially to FIG. 1, an air mover 2 is shown having a cylindrical motor housing 4, and an air exhaust nozzle 6 communicating therewith and extending tangentially therefrom. A handle 8 extends from motor housing 4 forming a portion of a substantially sine curve from the edge 10 at which the nozzle 6 meets the motor housing 4 to the grip 12 of the handle. Being that the motor is conventional, it will not be described. Although the preferred embodiment of the air mover 2 is a single piece of molded polymer, alternate types of material, including but not limited to, rubber or metal, are also contemplated.

Air mover 2 is terminated at planes on each side. One planar side contains motor mount inlet 14. The opposite planar side (seen in FIG. 3) contains detachable screen inlet 16. A motor is internally attached to fan motor housing 4 at the motor mount inlet 14 by conventional means. The motor can be positioned inside the motor housing 4 by removing detachable screen inlet 16. The perforations in the motor mount inlet 14 and detachable screen inlet 16 permit the influx of air to the internally mounted motor.

Figure 4:
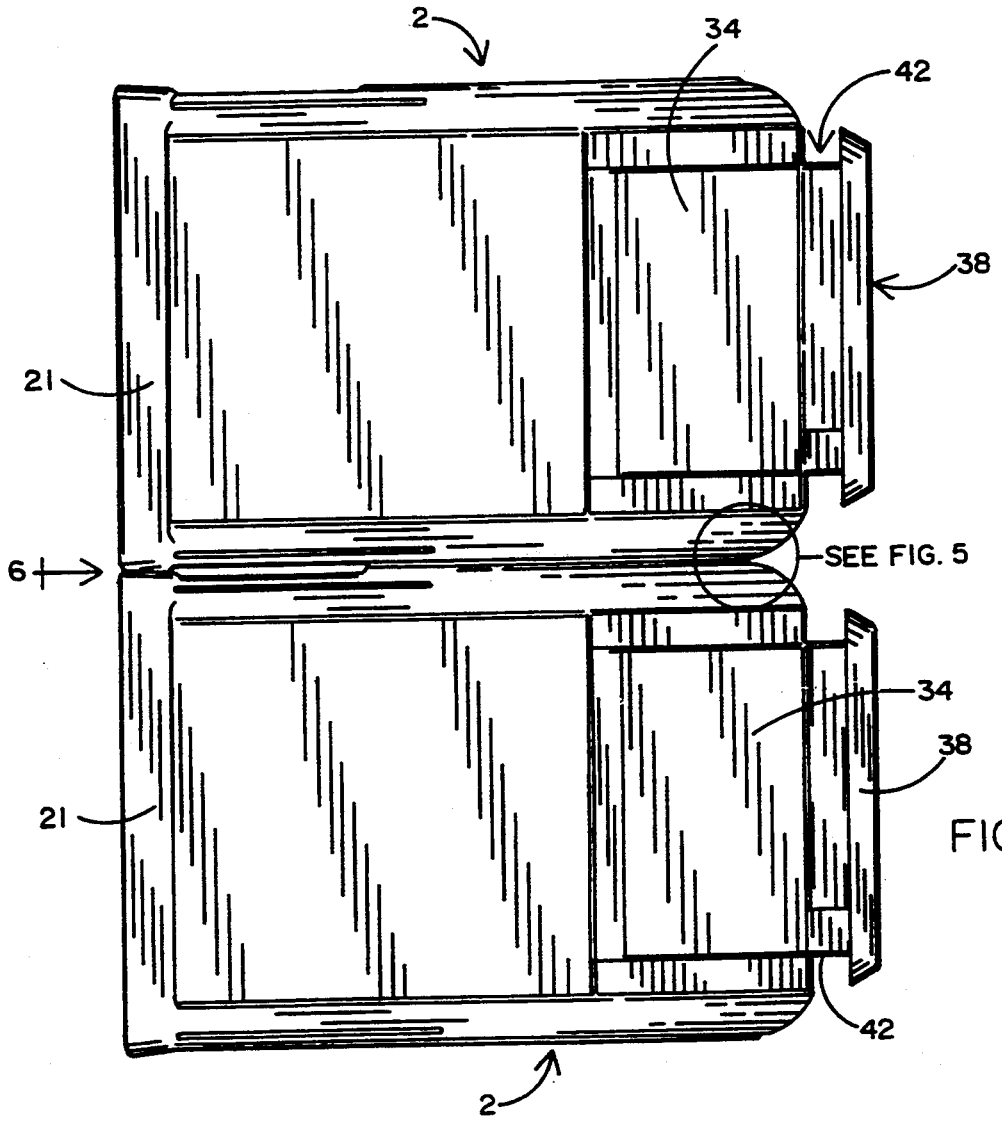
FIG. 4 is a bottom view showing the coaxially stacked and interlocking of two air movers.
Figure 5:
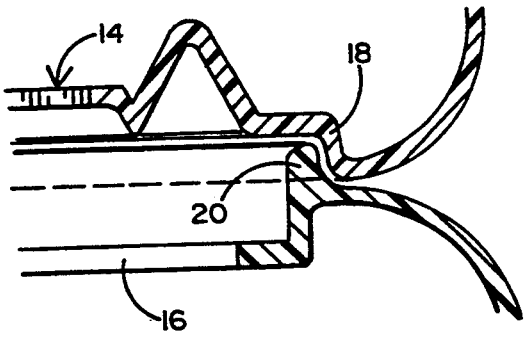
FIG. 5 is an enlarged cross-section showing the interlocking of the stacked air movers about the register stacking rings.
Figure 6:
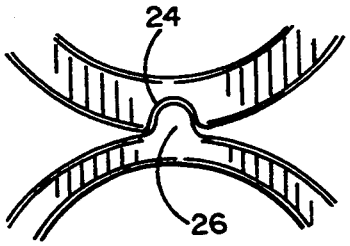
FIG. 6 is an enlarged front plan view showing the interlocking of the stacked air movers at the nozzle end.

Motor mount inlet 14 is surrounded by a circular depression 18 (best seen in FIG. 5). Surrounding detachable screen inlet 16 is a circular projection 20 (best seen in FIG. 5). The inwardly disposed diameter of circular depression 18 is greater than the outwardly disposed diameter of circular projection 20 such that when one air mover 2 is coaxially stacked upon another as seen in FIG. 4, circular projection 20 snugly interfits within circular depression 18 as seen in detail in FIG. 5. Inasmuch as circular projection 20 and circular depression 18 are rings, the coaxially stacked air movers 2 are stabilized in every lateral direction.

At the distal end of the air exhaust nozzle 6 is a flange or an accessory ring 20 which is a thickened band. The accessory ring 21 has an elongated slot 24 on the same planar side as the motor mount inlet 14 and a tab 26 on the same planar side as detachable screen inlet 16. The tab 26 and slot 24 are shaped and positioned on accessory ring 21 such that they snugly engaged when one air mover 2 is coaxially stacked atop the other (best shown FIGS. 4 and 6). The interlocking of slot 24 with tab 26 in conjunction with the interfit of circular depression 18 and circular projection 20 restricts the orientation of the coaxially stacked air movers 2.

Accessory flange or ring 21 allows it to be used, as the name implies, for the attachment of-other accessories which may be used along with the air mover 2. Such attachments are well-known to those skilled in the art. Accessory ring 21 has a flange underside 29 (seen best in FIGS. 2 and 3).

Figure 3:
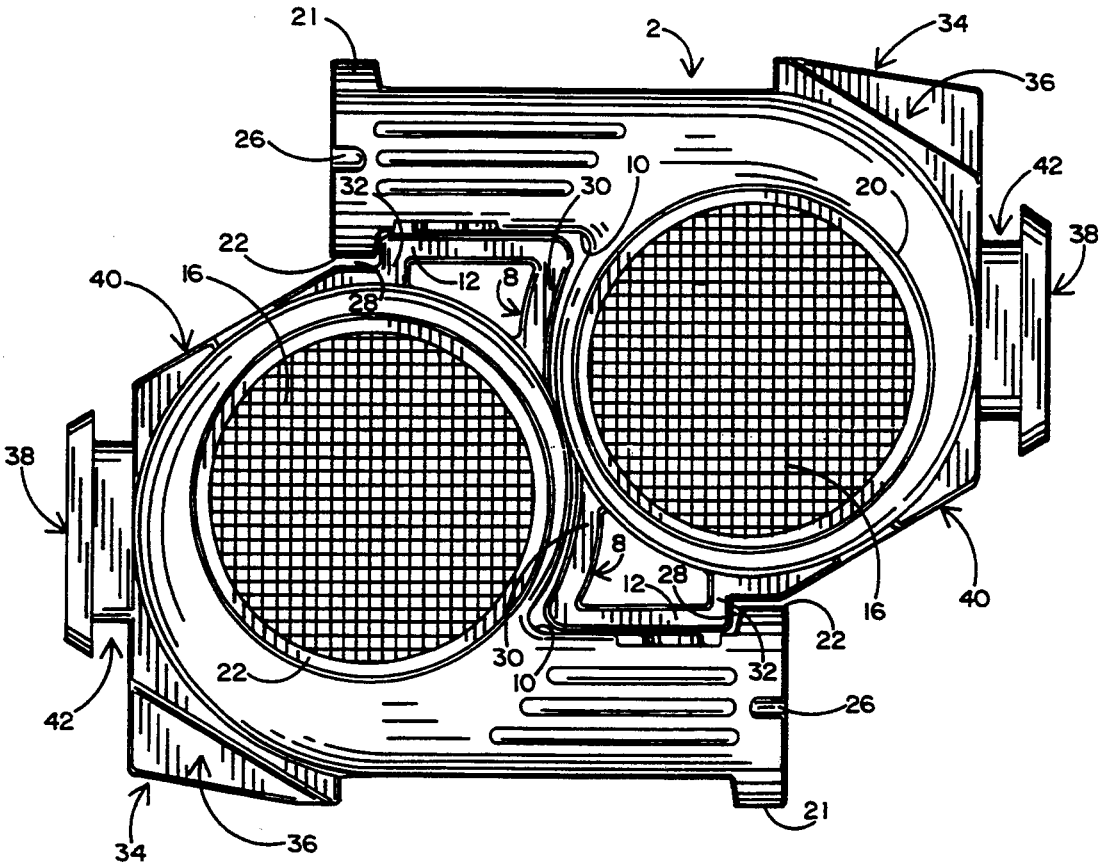
FIG. 3 is a side elevation showing two side by side interlocking air movers.

The handle 8 is comprised of grip 12 and two supports to the motor housing 4. The first support 30 is more proximal to edge 10 and air exhaust nozzle 6. The second support is elongated extending axially substantially from one planar side to the other planar side of motor housing 4 forming stacking register 32. When air movers 2 are stacked side-by-side as seen in FIG. 3, the distance from edge 10 to flange underside 29 is approximately the same as the length of grip 12 of handle 8. In addition, the flange underside 29 is substantially the same length as the width of stacking register 32. In the side-by-side position, handle 8 interlocks into the space formed by motor housing 4, edge 10 and accessory ring 21 with grip 12 and stacking register 32 further securing the side-by-side air movers 2. This interlock pattern is complementary, recurring with the accessory ring 21, handle 8, edge 10 and motor housing 4 seen on the reflected plane which runs through the central points of the screen inlets 16 when the air movers 2 are interlocked side-by-side.

The air mover 2 has several bases or feet upon which it may rest and vary the directional flow of the exhaust air through air exhaust nozzle 6. The air mover 2 may rest upon accessory ring 21 and base 34 thereby directing the exhaust air along the floor or resting surface. Air mover 2 has a pair of lower angled feet 36, a single rear foot 38 and a pair of upper angled feet 40. The air mover 2 may rest on any of these surfaces to alter the direction of the exhaust air through nozzle 6 as desired.

Between the rear foot 38 and the motor housing 4 there is a recessed area, cord wrap 42, about which the cord from the motor which extends through cord access 44 (seen in FIG. 2) can be stored.

Seen in FIG. 1 on upper angled foot 40 is a substantially rectangular switch recess 46. This is to receive control switches for the air mover 2. On air exhaust nozzle 6 there is an irregularly shaped accessory recess 48 (best seen in FIGS. 1 and 2) reserved for other accessories which may be used with or added to the air mover. Although switch recess 46 and accessory recess 48 are shown as having a certain shape, the use of other shapes is also contemplated according to the accessory or shape of the control switch to be used.

Thus, there is shown and described a preferred embodiment of the instant invention. Those skilled in the art may conceive of modifications or variations to the described embodiment. However, any such modifications or variations which fall within the purview of this description are intended to be included therein as well. For example, although these interlocking systems have been shown on an air mover, this is not to be regarded as a limitation of the applicability and usefulness of the interlocking systems. The description is intended to be illustrative only and is not intended to be limitive. Rather, the scope of the invention is limited only by the claims appended hereto.

What is claimed:

1. An air mover comprising:

a substantially cylindrical fan housing having an axis, an air exhaust nozzle extending tangentially from said fan housing and having a first side nearer said axis and a second side farther from said axis, a handle having a first edge attached to said cylindrical fan housing and a second edge;

said air mover defining a first point at which said first side of said air exhaust nozzle meets said cylindrical housing, a second point between said first and said second edge of said handle and a third point midway between said first and second points such that a surface of said air mover between said first and said third point is complementary to a surface of said air mover between said second and said third points.

2. The air mover as recited in claim 1 wherein the surface between said third point and said second point has a concave profile, and where the surface between said third point and said first point has a convex profile.

3. The air mover as recited in claim 1 wherein said first edge of said handle is closer to said axis of said air mover than said second edge of said handle.

4. The air mover as recited in claim 1 wherein said handle comprises:

a grip forming said second edge;

a first handle support extending between said cylindrical fan housing and said grip forming said first edge; and a second handle support extending between said cylindrical fan housing and said grip.

5. The air mover as recited in claim 4 wherein said first handle support forms a portion of said surface between said third point and said second point.

6. The air mover as recited in claim 4 wherein said grip is parallel to said second side of said air nozzle.

7. The air mover as recited in claim 5 further comprising a flange at an end of said air exhaust nozzle defining a flange underside perpendicular to said first side of said air exhaust nozzle having a first edge adjacent said first side of said air exhaust nozzle and a second edge; a surface from said second edge of said flange underside to said third point being complementary to a surface from said third point to a length of attachment adjacent said second handle support whereby one said air mover may be complementary interlocked with another said air mover.

8. The air mover as recited in claim 7 wherein both said flange underside and said second handle support extend substantially the axial length of said cylindrical fan housing.

9. The air mover as recited in claim 1 wherein said cylindrical fan housing has a first plane having a first planar inlet and has a second plane having a second planar inlet parallel to said first planar inlet; said air mover having a circular projection from said first planar inlet having an outwardly disposed diameter, said second planar inlet having an inwardly disposed diameter having a magnitude greater than said outwardly disposed diameter of said circular projection.

10. The air mover as recited in claim 9 wherein said air exhaust nozzle extends substantially the axial length of said substantially cylindrical fan housing approaching said first plane of said first planar inlet and said second plane of said second planar inlet, a first side edge of said air exhaust nozzle having a tab extending beyond said first plane and an opposite second side edge having a slot within said second plane and complementary to said tab.

11. A coaxially stackable air mover comprising a substantially cylindrical fan housing having a first planar inlet defining a first plane and a second planar inlet defining a second plane and parallel to said first planar inlet, said first planar inlet having a circular projection from said planar inlet having an outwardly disposed diameter, said second planar inlet having a circular depression having an inwardly disposed diameter greater than said outwardly disposed diameter of said circular projection whereby the first planar inlet of one said coaxially stackable air mover may interfit and stack with said second planar inlet of another said coaxially stackable air mover; and an air exhaust nozzle extending tangentially from said fan housing.

12. The coaxially stackable air mover as recited in claim 11 further comprising means, attached to said second planar inlet, for supporting a motor and allowing air to pass through said second planar inlet.

13. The coaxially stackable air mover as recited in claim 11 wherein said air exhaust nozzle extending substantially the axial length of said substantially cylindrical fan housing approaching said first plane of said first planar inlet and said second plane of said second planar inlet, a first side edge of said air exhaust nozzle having a tab extending beyond said first plane and an opposite second side edge having a slot within said second plane and complementary to said tab.

14. The process of interlocking air movers comprising the steps of:

providing at least two air movers each having a substantially cylindrical fan housing having an axis, an air exhaust nozzle extending tangentially from said fan housing and having a first side nearer said axis and a second side farther from said axis, a first handle support extending from said cylindrical fan housing and defining a first edge, and a second handle support having a grip and extending between said cylindrical fan housing and said first handle support and defining a second edge; a flange at an end of said air exhaust nozzle defining a flange underside perpendicular to said first side of said air exhaust nozzle having a first edge adjacent said first side of said air exhaust nozzle and a second edge; such that the surface from said second edge of said flange underside to a path midpoint is complementary to a surface from said path midpoint to a length of attachment between said grip and said second handle support;

placing one of said at least two air movers in relation to another one of said at least two air movers such that said complementary surface of said one of said plurality of air movers opposes said complementary surface of said other air mover.

15. The process of interlocking air movers as recited in claim 14, and further comprising the process of stacking comprising the steps of:

providing at least a third said air mover each of said air movers further having on said substantially cylindrical fan housing a first planar inlet and second planar inlet parallel to said first planar inlet, a circular projection extending from said first planar inlet having an outwardly disposed diameter, and said second planar inlet having a circular depression having an inwardly disposed diameter of a magnitude greater than the outwardly disposed diameter of said circular projection; and placing said at least a third air mover coaxially on one of said circular projections of said at least two air movers to interfit said circular depression of said at least a third air mover.

16. The process of interlocking and stacking air movers as recited in claim 15 and further wherein said air exhaust nozzle extends substantially the axial length of said substantially cylindrical fan housing and approaches said first plane of said first planar inlet and said second plane of said second planar inlet;

providing a first side edge of said air exhaust nozzle having a tab extending beyond said first plane and an opposite second side edge having a slot within said second plane and complementary to said tab; and placing said slot of said at least a third air mover onto one said tab of said one or said other air movers.

17. The process of interlocking and stacking air movers as recited in claim 16 further comprising the steps of:

providing at least a fourth air mover structurally identical to said first, second, and third air movers;

placing said at least a fourth air mover coaxially on the other one of said at least two air movers such that the said circular projection of the other, of said one and said other air mover, interfits said circular depression of said at least a fourth air mover; and such that said slot of said at least a fourth air mover interfits into the tab of another, of one said one and said other, air mover; and such that said at least a fourth air mover is in relation to said at least a third air mover such that said complementary surface of said at least a fourth air mover opposes said complementary surface of said at least a third air mover.

* * * * *